US006978494B2

(12) United States Patent
Wu

(10) Patent No.: US 6,978,494 B2
(45) Date of Patent: Dec. 27, 2005

(54) INFLATABLE CONTAINER WITH A WATER DRAINING DEVICE

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 153 days.

(21) Appl. No.: 10/755,761

(22) Filed: Jan. 12, 2004

(65) Prior Publication Data

US 2005/0000567 A1 Jan. 6, 2005

(30) Foreign Application Priority Data

Jul. 3, 2003 (TW) ..... 03266710 U

(51) Int. Cl.[7] ..... E04H 4/14
(52) U.S. Cl. ..... 4/507; 4/585; 285/201
(58) Field of Search ..... 4/506, 507, 585, 4/588; 285/141.1, 201, 205

(56) References Cited

U.S. PATENT DOCUMENTS 265,886 A * 10/1882 Stover ..... 285/205 X
2,443,440 A * 6/1948 Alvarez ..... 4/506
4,535,490 A * 8/1985 Wright ..... 4/585 X
5,247,712 A * 9/1993 Williams ..... 4/585
5,971,444 A * 10/1999 Hawkins ..... 285/201 X
6,192,528 B1 * 2/2001 Martinez ..... 4/507

* cited by examiner

*Primary Examiner*—Robert M. Fetsuga
(74) *Attorney, Agent, or Firm*—Frommer Lawrence & Haug LLP; Ronald R. Santucci

(57) ABSTRACT

An inflatable container includes a container body that defines a water-storage space, and that has a bottom wall, peripheral inner and outer walls extending upwardly from the bottom wall, and a top wall interconnecting the peripheral inner and outer walls to define an air chamber thereamong. A draining device includes a tubular member that extends through the peripheral inner and outer walls, that is connected sealingly to the peripheral inner and outer walls, and that defines a passage in spatial communication with the water-storage space and an exterior of the container body. A valve is associated with the tubular member for controlling opening and closing of the passage in the tubular member.

4 Claims, 7 Drawing Sheets

INFLATABLE CONTAINER WITH A WATER DRAINING DEVICE

This application claims priority benefits of Chinese patent application number 03266710.8 filed Jul. 3, 2003

BACKGROUND OF THE INVENTION

1. Field of the Invention

The invention relates to a water container, more particularly to an inflatable water container with a draining device for effectively draining the water in the container when desired.

2. Description of the Related Art

Referring to FIG. 1, a conventional inflatable container 1 is shown to include a container body 11 that defines a water-storage space 114, and that has a bottom wall 111, spaced-apart peripheral inner and outer walls 112, 113 extending upwardly from the bottom wall 111, and a top wall 116. The top wall 116 interconnects top ends of the peripheral inner and outer walls 112, 113, and cooperates with the bottom wall 111 and the peripheral inner and outer walls 112, 113 to define an air chamber 110 thereamong. The bottom wall 111 of the container body 11 is formed with a drain hole 125 which is defined by a hole-confining wall 115 and which is communicated with the water-storage space 114. A valve unit 12 includes a plug 122 and a valve seat 121 having a tubular portion 124 fitted sealingly in the drain hole 125 in the bottom wall 111, and an annular flange 123 that extends outwardly and radially from the tubular portion 124 and that is seated on a periphery of the hole-confining wall 115. The plug 122 is fastened to the valve seat 121 through a flexible string, and includes a plug piece 127 that is insertable detachably into the drain hole 125 for closing the drain hole 125, and a pull flap 126 integrally formed with the plug piece 127 to facilitate removal of the plug piece 127 from the drain hole 125.

Some disadvantages that result from use of the conventional inflatable container 1 are as follows:

(1) Draining of the water from the water-storage space 114 in the container body 11 is slow due to close abutment between the bottom wall 111 of the container body 11 and a supporting surface that supports the inflatable container 1.

(2) It is difficult to connect a hose to the valve unit 12 for draining water in the water-storage space 114 into a tank or the like for recycling purposes.

(3) Filling the water-storage space 114 with water requires the user to hold a hose that is connected to a faucet, which is laborious.

SUMMARY OF THE INVENTION

Therefore, the object of this invention is to provide an inflatable container which can overcome the aforementioned disadvantages resulting from the use of the conventional inflatable container.

Accordingly, an inflatable container of the present invention includes: an inflatable container body that defines a water-storage space, and that has a bottom wall, spaced-apart peripheral inner and outer walls extending upwardly from the bottom wall, and a top wall interconnecting the peripheral inner and outer walls and cooperating with the bottom wall and the peripheral inner and outer walls to define an air chamber thereamong; and a draining device including a tubular member that extends transversely through the peripheral inner and outer walls, that is connected sealingly to the peripheral inner and outer walls, and that defines a passage in spatial communication with the water-storage space and an exterior of the container body, and a valve associated with the tubular member and operable to control opening and closing of the passage in the tubular member.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
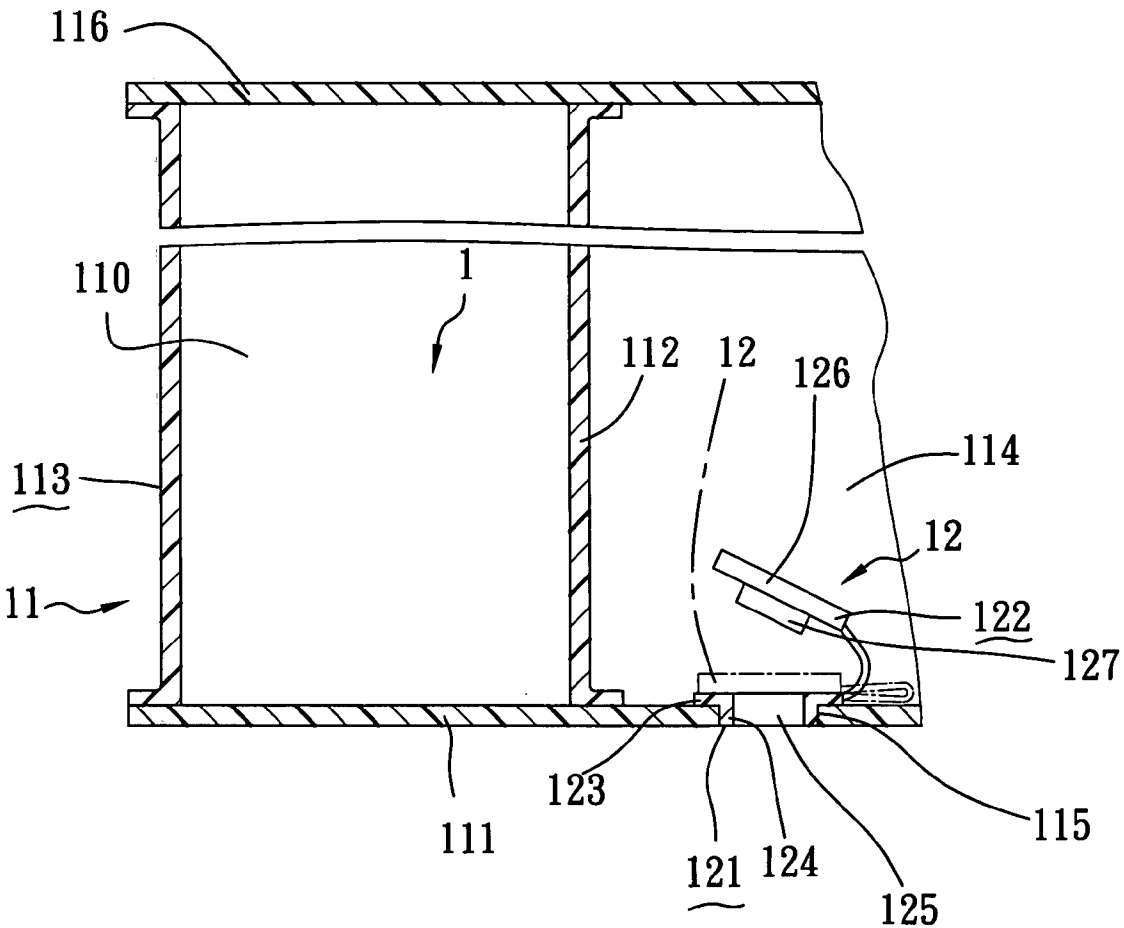
FIG. 1 PRIOR ART
FIG. 1 is a fragmentary sectional view of a conventional inflatable container.
Figure 2:
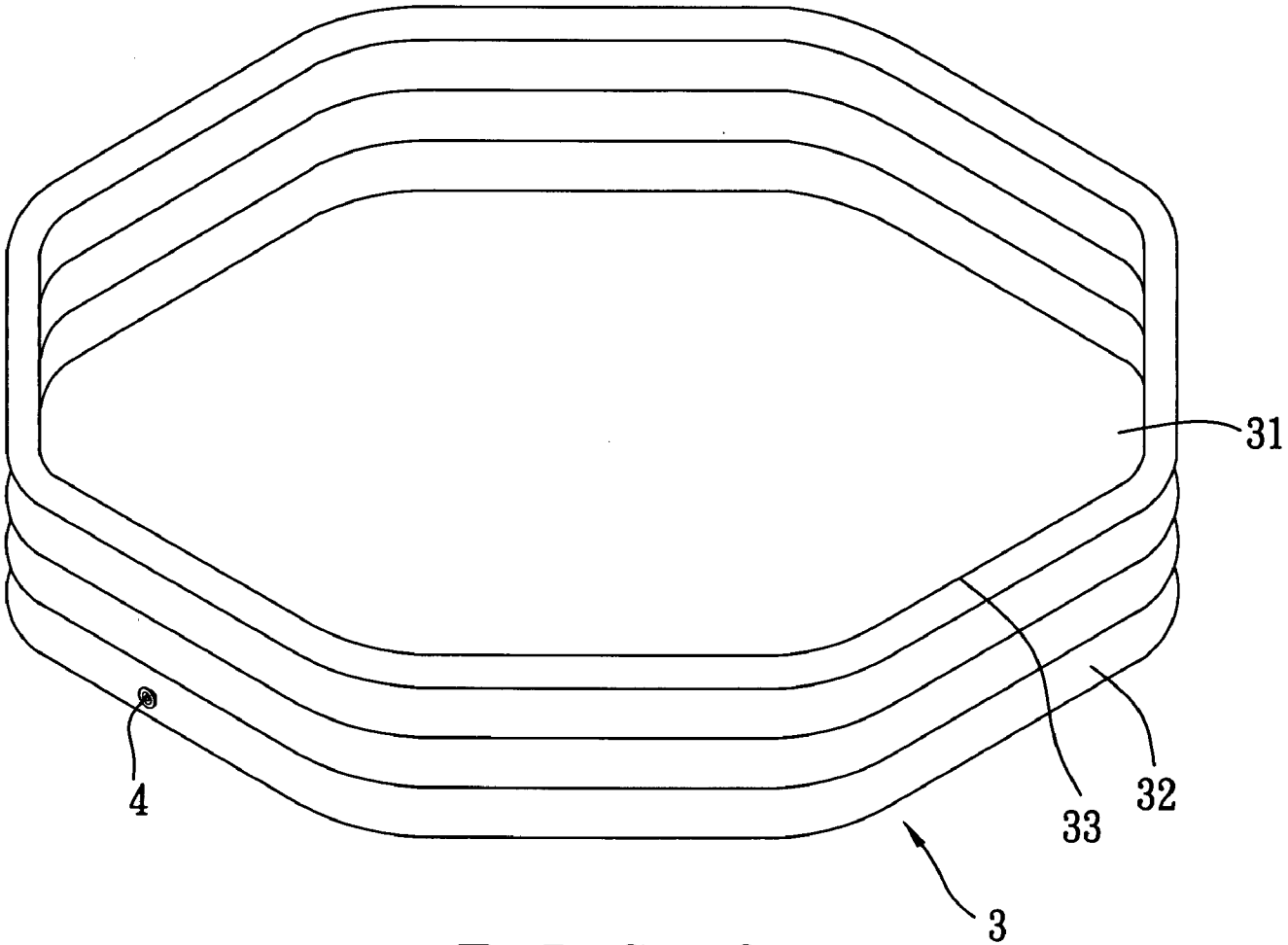
FIG. 2 is a perspective view of the preferred embodiment of an inflatable container of the present invention.

Referring to FIGS. 2 to 5, the preferred embodiment of an inflatable container according to the present invention is shown to include an inflatable container body 3 and a draining device 5.

As illustrated, the inflatable container body 3 defines a water-storage space 33, and has a bottom wall 31, spaced-apart peripheral inner and outer walls 321, 322 extending upwardly from the bottom wall 31, and a top wall 519. The top wall 519 interconnects top ends of the peripheral inner and outer walls 321, 322, and cooperates with the bottom wall 31 and the peripheral inner and outer walls 321, 322 to define an air chamber 323 thereamong. A conventional air valve (not shown) can be provided for access of air into the air chamber 323 or release of air therefrom. Since the feature of the present invention does not reside in the structure of the air valve, a detailed description of the same is omitted herein for the sake of brevity.

The draining device 5 includes a tubular member 51 that extends transversely through the peripheral inner and outer walls 321, 322, that is connected sealingly to the peripheries of two holes 324, 325 that are formed in the peripheral inner and outer walls 321, 322, respectively, and that defines a passage 512 in spatial communication with the water-storage space 33 and an exterior of the container body 3, and a valve 7 that is mounted on the peripheral inner wall 321, that is associated with the tubular member 51, and that is operable to control opening and closing of the passage 512 in the tubular member 51.

In this embodiment, the tubular member 51 includes a hollow tubular pipe 511 which has an inner end 513 connected sealingly to the periphery of the hole 324 in the peripheral inner wall 321, an outer end 514 that is opposite to the inner end 513 and that is formed with an external thread 526. The tubular member 51 is formed with a conical flange 52 that is integrally formed on the outer end 514 of the hollow tubular pipe 511, and that has a peripheral wall 523 surrounding the external thread 526 and extending into the air chamber 323, and an annular connecting flange 521 that extends radially and outwardly from the peripheral wall 523 of the conical flange 52 and that abuts sealingly against the periphery of the hole 325 in the peripheral outer wall 322. The draining device 5 further includes a plurality of spaced-apart annular reinforced ribs 515 that extend radially and outwardly from the tubular pipe 511 so as to enhance the rigidity and strength of the tubular member 51.

The valve 7 includes a valve seat 6 and a plug 72. The valve seat 6 has a tubular portion 63 that is press-fitted into the tubular pipe 511 and that defines a valve opening 64 in spatial communication with the passage 512 and the water-storage space 33, and an abutting flange 61 that extends radially and outwardly from the tubular portion 63 and that is sealingly connected to the peripheral inner wall 321. The plug 72 is connected to the flange 61 of the valve seat 6 through a string 8, and can be inserted detachably into the valve opening 64 in the valve seat 6 for temporarily blocking the passage 512 in the tubular pipe 511. Preferably, the plug 72 is formed with a pull tab 71 that protrudes radially and outwardly therefrom to facilitate removal of the plug 72 from the valve seat 6.

Figure 3:
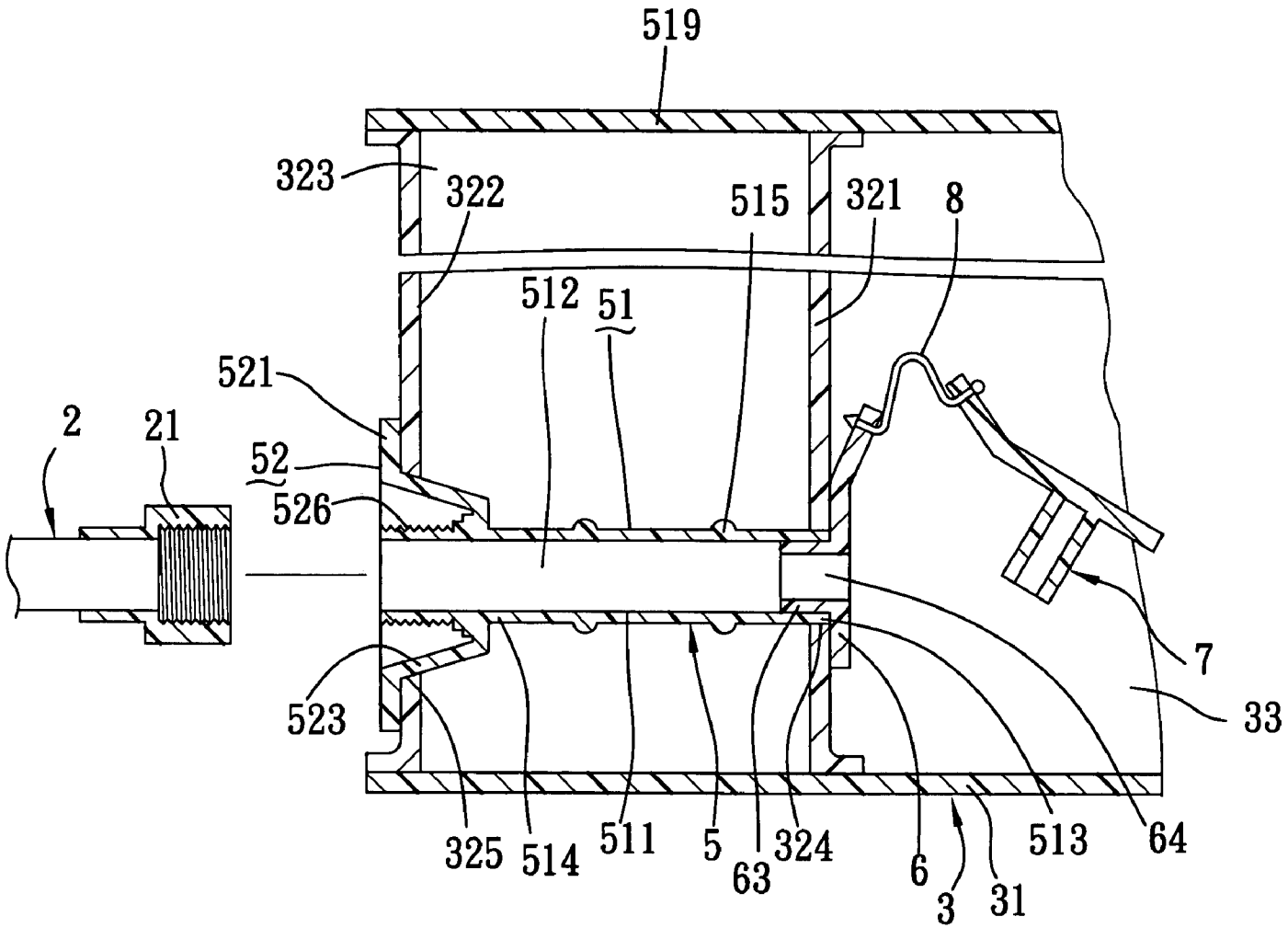
FIG. 3 is a fragmentary sectional view illustrating how the inflatable container of the preferred embodiment is connected to a water hose for introduction of water thereinto.
Figure 4:
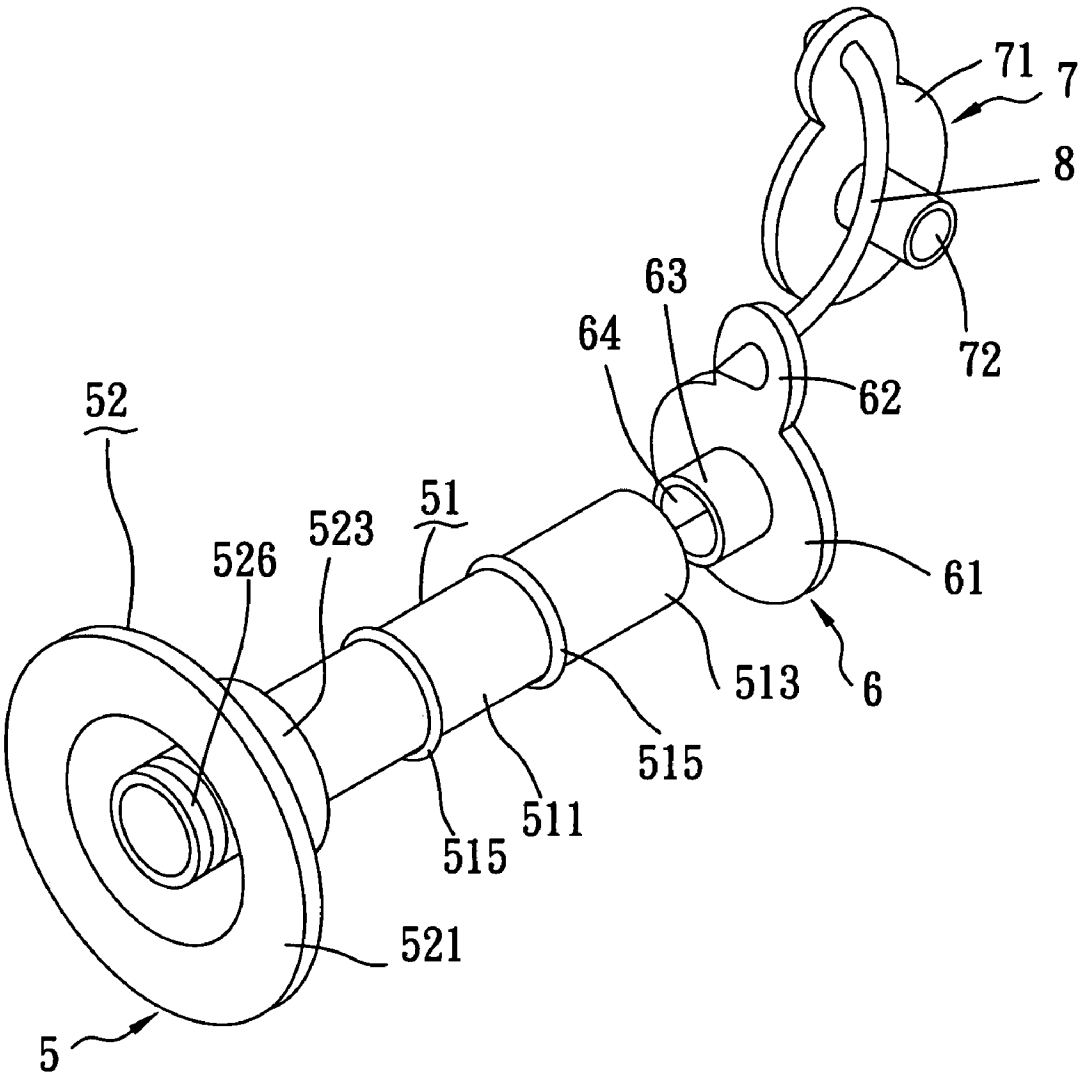
FIG. 4 is a perspective view of a draining device employed in the preferred embodiment.
Figure 5:
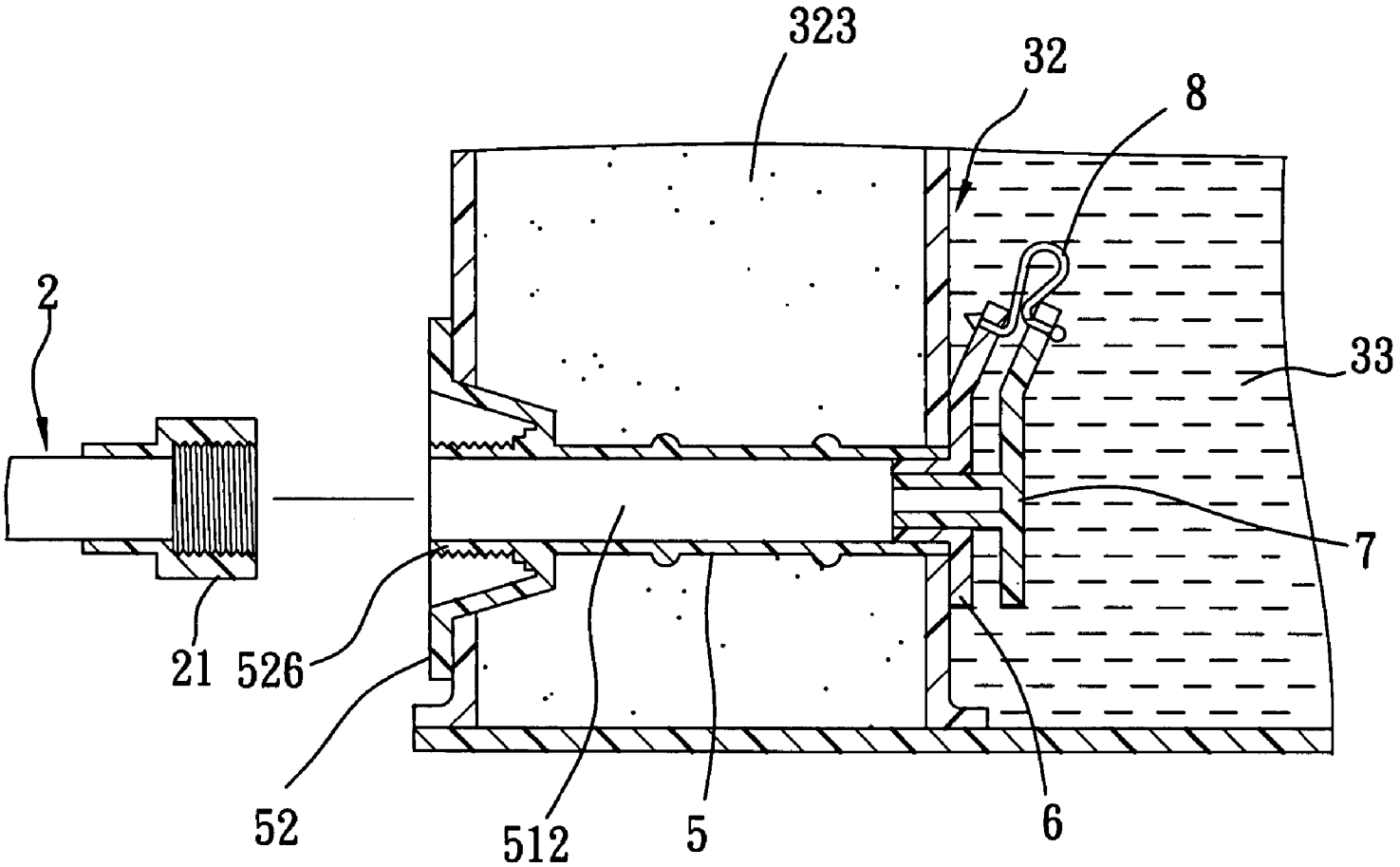
FIG. 5 is a fragmentary sectional view illustrating the preferred embodiment in a state of use.

Referring to FIGS. 3 and 5, when it is desired to discharge water from the water-storage space 33 in the container body 3 or introduce water into the water-storage space 33, the external thread 526 of the tubular pipe 511 can be connected threadedly to a coupling head 21 of a water hose 2. The plug 72 is removed or inserted detachably into the valve opening 64 for temporarily closing or opening the passage 512 in the tubular pipe 511.

Figure 6:
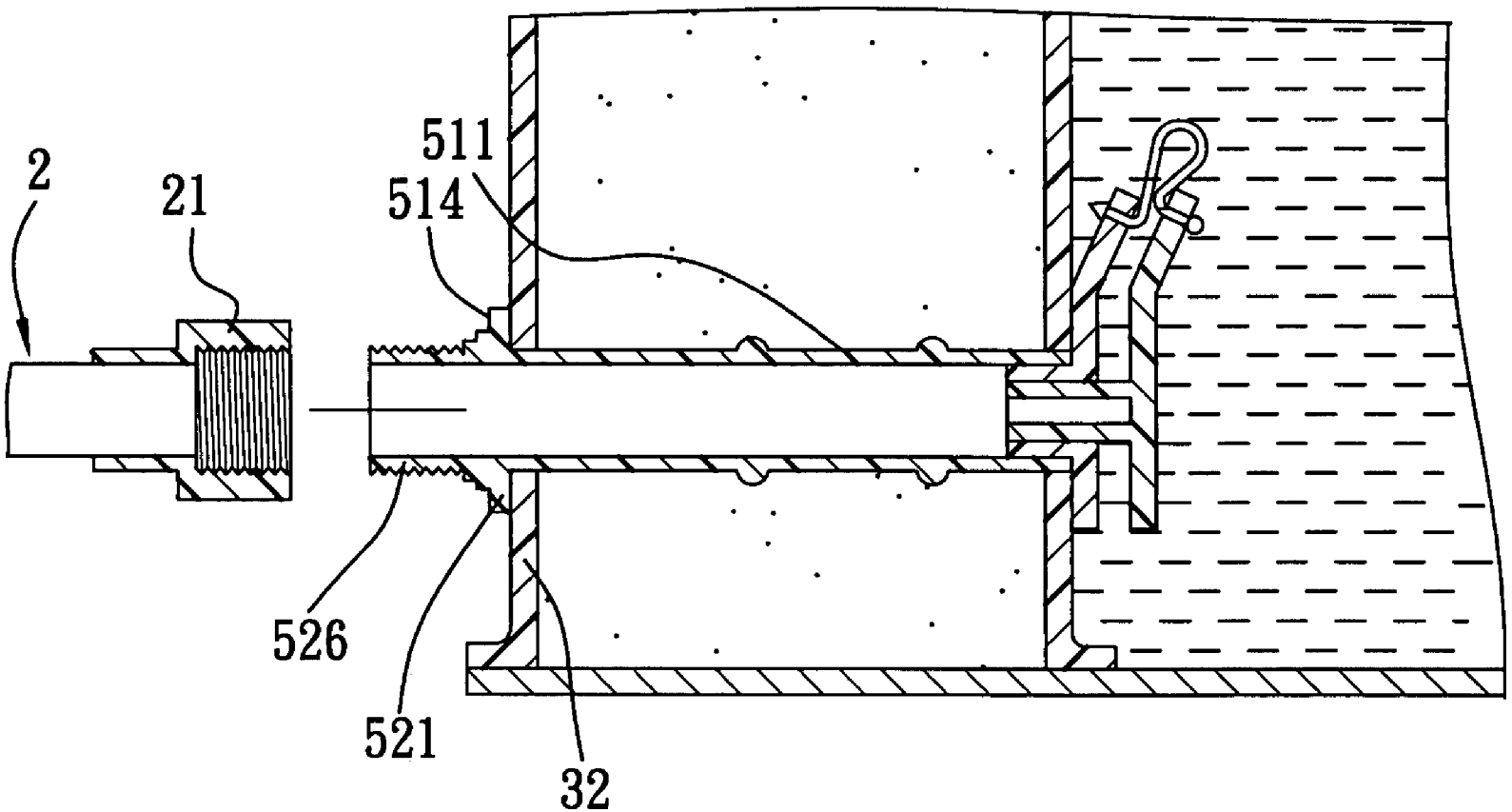
FIG. 6 is a fragmentary sectional view of a modified preferred embodiment of the present invention.

Referring to FIG. 6, a modified preferred embodiment of the present invention is shown to have a structure similar to the previous embodiment, except that the outer end 514 of the tubular pipe 511 is exposed from the container body 3 so as to further facilitate threaded connection with the coupling head 21 of the water hose 2.

Figure 7:
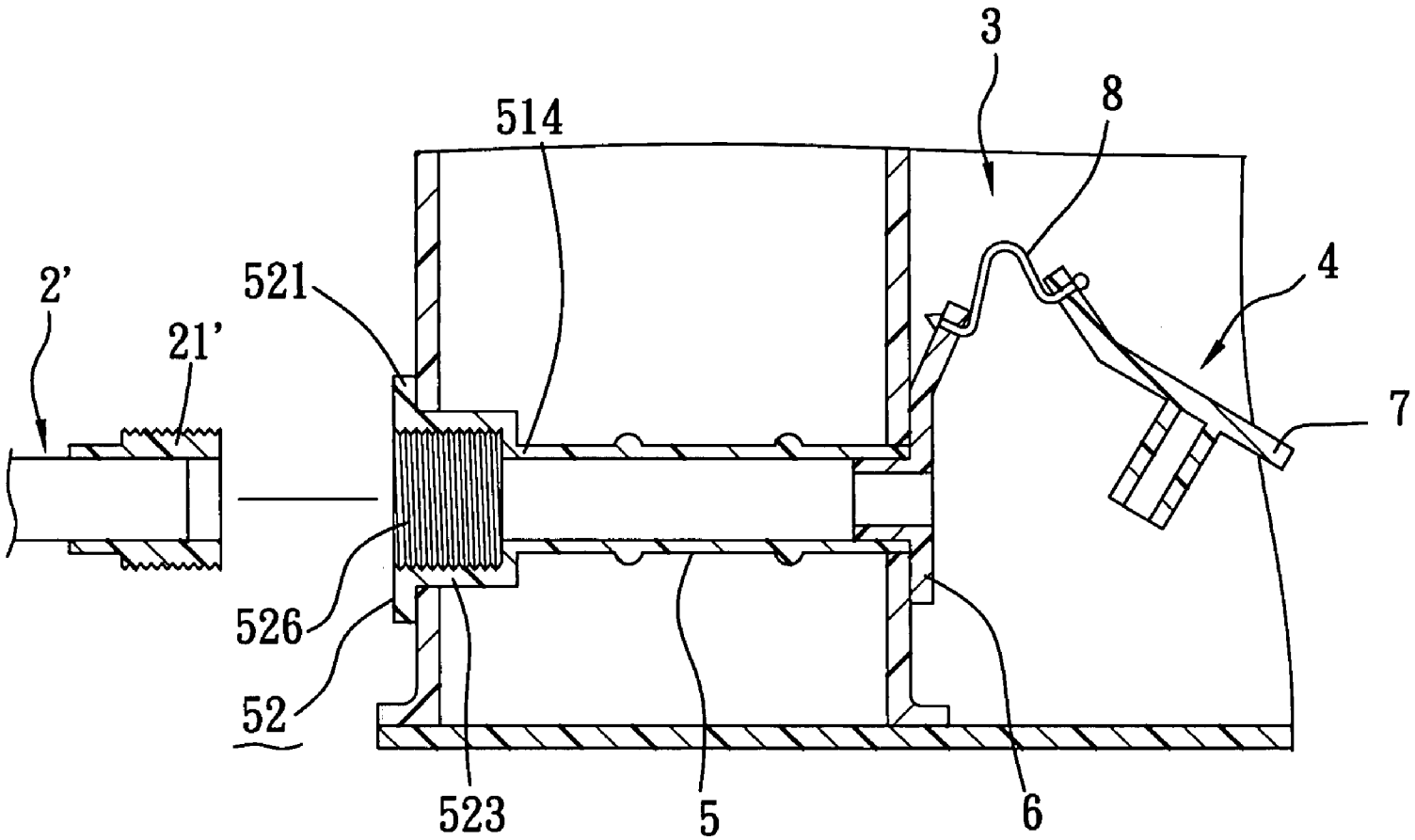
FIG. 7 is a fragmentary sectional view of another modified preferred embodiment of the present invention.

Referring to FIG. 7, another modified preferred embodiment of the present invention is shown to have a structure similar to the previous embodiment, except that the outer end 514 of the tubular pipe 511 is formed with an internal thread 526 for threaded connection with the coupling head 21' of the water hose 2'.

Since the valve 7 is installed at the peripheral inner wall 321, the aforesaid drawbacks as encountered in the prior art during draining can be eliminated. Moreover, with the arrangement the tubular pipe 511, the draining device 5 can be connected to the water hose 2 for filling the water-storage space 33 in the container body 3 with water.

With this invention thus explained, it is apparent that numerous modifications and variations can be made without departing from the scope and spirit of this invention. It is therefore intended that this invention be limited only as indicated in the appended claims.

I claim:

1. An inflatable container comprising:

an inflatable container body that defines a water-storage space, and that has a bottom wall, spaced-apart peripheral inner and outer walls extending upwardly from said bottom wall, and a top wall interconnecting said peripheral inner and outer walls and cooperating with said bottom wall and said peripheral inner and outer walls to define an air chamber thereamong; and a draining device including a tubular member that extends transversely through said peripheral inner and outer walls, that is connected sealingly to said peripheral inner and outer walls, and that defines a passage in spatial communication with said water-storage space and an exterior of said container body, and a valve associated with said tubular member and operable to control opening and closing of said passage in said tubular member.

2. The inflatable container as defined in claim 1, wherein said draining device further includes a plurality of spaced-apart annular reinforced ribs extending radially and outwardly from said tubular member so as to enhance rigidity and strength of said tubular member.

3. The inflatable container as defined in claim 1, wherein said valve includes a valve seat having a tubular portion that is press-fitted into said tubular member and that defines a valve opening in spatial communication with said passage and said water-storage space, an abutting flange that extends radially and outwardly from said tubular portion and that is sealingly connected to said peripheral inner wall, a string, and a plug connected to said flange through said string and inserted detachably into said valve opening in said valve seat for temporarily blocking said passage in said tubular member.

4. The inflatable container as defined in claim 1, wherein each of said peripheral inner and outer walls is formed with a hole, said tubular member including a hollow tubular pipe which has an inner end connected sealingly to a periphery of said hole in said peripheral inner wall, and an outer end that is opposite to said inner end, that is connected sealingly to a periphery of said hole in said peripheral outer wall and that is formed with an external thread, said tubular member being formed with a conical flange that is integrally formed with said outer end of said tubular pipe, and that has a peripheral wall surrounding said external thread and extending into said air chamber, and an annular connecting flange that extends radially and outwardly from said peripheral wall of said conical flange and that abuts sealingly against said periphery of said hole in said peripheral outer wall.

* * * * *